US009783381B2

(12) United States Patent
Kawamata et al.

(10) Patent No.: US 9,783,381 B2
(45) Date of Patent: Oct. 10, 2017

(54) CONVEYOR

(71) Applicant: BROTHER KOGYO KABUSHIKI KAISHA, Nagoya-shi, Aichi-ken (JP)

(72) Inventors: Noriyuki Kawamata, Nagoya (JP); Yasuhira Ota, Yatomi (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/661,691

(22) Filed: Mar. 18, 2015

(65) Prior Publication Data

US 2015/0266684 A1 Sep. 24, 2015

(30) Foreign Application Priority Data

Mar. 19, 2014 (JP) ..... 2014-056200

(51) Int. Cl.
*B65H 5/02* (2006.01)
*B65H 5/06* (2006.01)

(52) U.S. Cl.
CPC ..... *B65H 5/062* (2013.01); *B65H 2402/441* (2013.01); *B65H 2402/45* (2013.01); *B65H 2403/513* (2013.01); *B65H 2404/1442* (2013.01); *B65H 2404/1451* (2013.01); *B65H 2404/152* (2013.01); *B65H 2404/6111* (2013.01); *B65H 2407/33* (2013.01); *B65H 2601/11* (2013.01)

(58) Field of Classification Search
CPC ..... B65H 2601/11; B65H 2402/441; B65H 2404/1451; B65H 2407/33
USPC ..... 271/273, 274
See application file for complete search history.

(56) References Cited

U.S. PATENT DOCUMENTS

2004/0175210 A1* 9/2004 Otaka ..... B65H 5/062 399/318
2013/0293656 A1 11/2013 Anami

FOREIGN PATENT DOCUMENTS

JP 2000-214718 A 5/1995
JP 7-125868 A 8/2000
JP 2009-003411 A 1/2009
JP 2013-230921 A 11/2013

OTHER PUBLICATIONS

Notice of Reasons for Rejection issued in related Japanese patent application No. 2014-056200, dated Nov. 22, 2016.

* cited by examiner

*Primary Examiner* — Howard Sanders
(74) *Attorney, Agent, or Firm* — Merchant & Gould P.C.

(57) ABSTRACT

A conveyor includes: a supporting member which supports the first and second roller units to allow the first and second rollers to take one of a first conveyance position and a first retracted position; a movable member which is movable between a first position where the first roller and the second roller take the first conveyance position and a second position where the rollers take the first retracted position; a cover member which is switchable between a closed state where the cover member is a part of the conveyance passage and an open state where a part of the conveyance passage is open; and an interlocking mechanism which is configured to move the movable member to the second position when the cover member is in the open state and moves the movable member to the first position when the cover member is in the closed state.

16 Claims, 5 Drawing Sheets

CONVEYOR

CROSS REFERENCE TO RELATED APPLICATION

The present application claims priority from Japanese Patent Application No. 2014-056200, which was filed on Mar. 19, 2014, the disclosure of which is herein incorporated by reference in its entirety.

BACKGROUND OF THE INVENTION

1. Field of the Invention

The present invention relates to a conveyor for conveying sheets.

2. Description of Related Art

A known printer includes a first roller and a second roller which hold and convey paper (sheet), a roller supporting member which is switchable between a first state in which the second roller contacts with the first roller and a second state in which the second roller is separated from the first roller, and a slider configured to switch the state of the roller supporting member. In this printer, when paper jam occurs, the switching to the second state in which the second roller is separated from the first roller is performed in response to a user's operation of pulling out a slider. This makes it possible to easily remove the paper sandwiched between the first roller and the second roller.

In the printer above, after the removal of the jammed paper, the user operates the slider to switch to the first state in which the second roller contacts with the first roller. For this reason, if the user forgets to operate the slider and instructs paper conveyance without operating the slider, paper is not properly conveyed because the first roller and the second roller are still in the second state.

SUMMARY OF THE INVENTION

An object of the present invention according to an aspect of the invention is to provide a conveyor which is capable of properly conveying sheets.

A conveyor of the present invention includes: a first roller unit including a first roller; a second roller unit including a second roller which opposes the first roller and is configured to convey a sheet while holding the sheet with the first roller; a supporting member which supports the first and second roller units to allow the first and second rollers to take one of a first conveyance position where the first roller and the second roller convey the sheet while holding the sheet and a first retracted position where a holding force by which the sheet is held by the first roller and the second roller is smaller than a holding force at the first conveyance position; a movable member which is engaged with at least one of the first and second roller units and is movable between a first position where the first roller and the second roller take the first conveyance position and a second position where the first roller and the second roller take the first retracted position; a cover member which includes a guide unit which is a part of a conveyance passage for conveying the sheet and is switchable between a closed state where the cover member is a part of the conveyance passage and an open state where a part of the conveyance passage is open; and an interlocking mechanism which is configured to move the movable member to the second position when the cover member is in the open state and moves the movable member to the first position when the cover member is in the closed state.

BRIEF DESCRIPTION OF THE DRAWINGS

FIG. 4A is a cross section taken at the IV-IV line in FIG. 3, whereas

FIG. 5A is a cross section taken at the V-V line in FIG. 3, whereas

DESCRIPTION OF THE PREFERRED EMBODIMENTS

Figure 1:
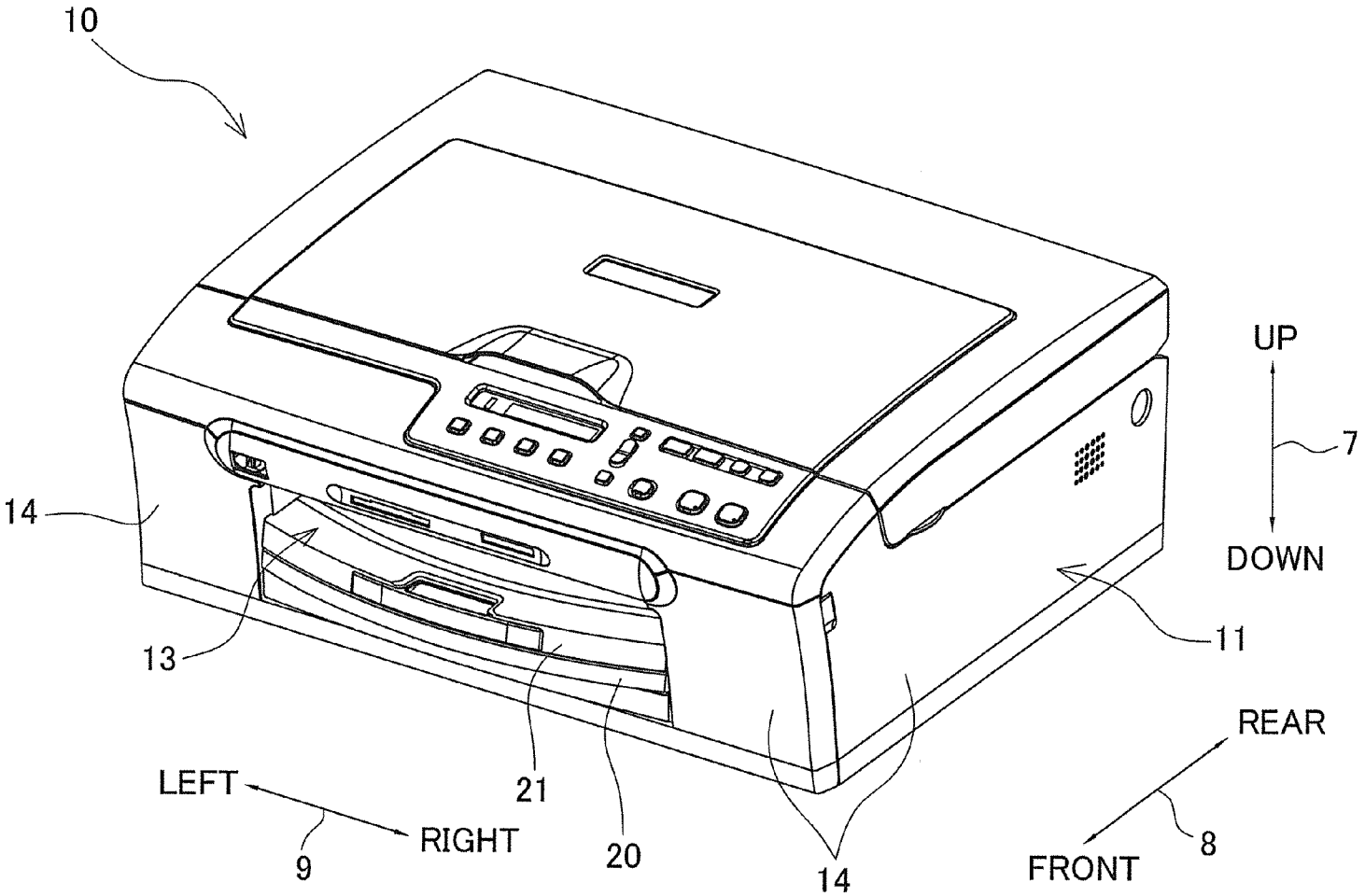
FIG. 1 is an oblique perspective of a multifunction machine employing a conveyor of an embodiment of the present invention.

The following will describe a preferred embodiment of the present invention suitably referring to figures. In the descriptions below, an up-down direction 7 is defined with reference to a state (shown in FIG. 1) in which a multifunction machine 10 employing a conveyor 1 of an embodiment of the present invention is disposed to be readily usable, a front-rear direction 8 is defined on the assumption that the side on which an opening 13 is provided is the front side (front), and a left-right direction 9 is defined on the assumption that the multifunction machine 10 is viewed from the front side (i.e., the front of the machine 10 is viewed).

Overall Structure of Multifunction Machine 10

Figure 2:
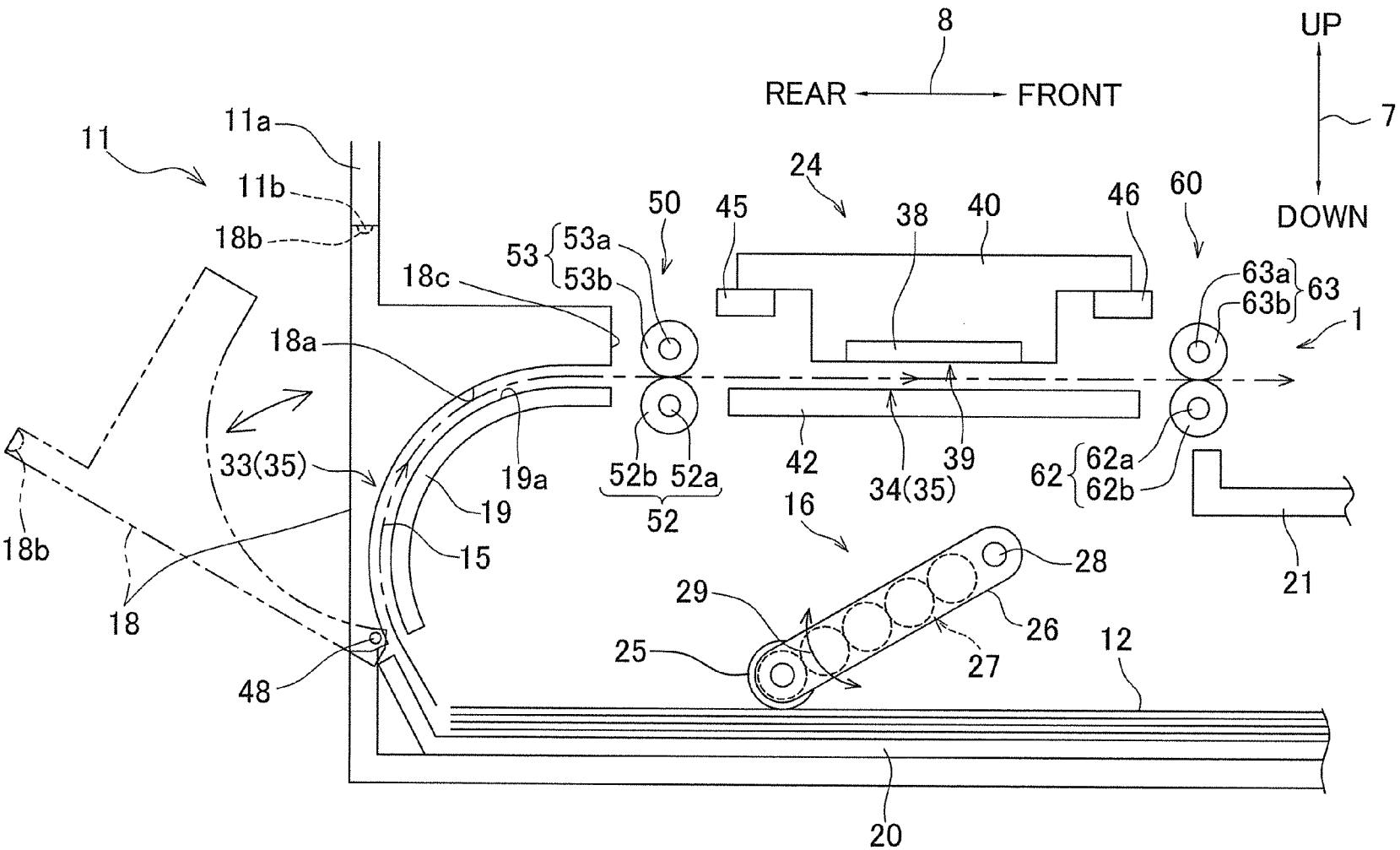
FIG. 2 is a schematic profile showing the internal structure of the printer unit shown in FIG. 1.

As shown in FIG. 1, the multifunction machine 10 is substantially rectangular parallelepiped in shape and is provided with a printer unit 11 at a lower part. The multifunction machine 10 has functions such as a facsimile function and a printing function. As the printing function, the multifunction machine 10 has a function of recording an image on one side of paper 12 (sheet: see FIG. 2) by inkjet. The multifunction machine 10 may record images on both sides of the sheet 12. As shown in FIG. 2, the printer unit 11 includes a conveyor 1 which is configured to convey the sheet 12 inside the multifunction machine 10. The conveyor 1 includes later-described members such as a casing 11*a*, a feeding unit 16, a platen 42, a conveyor roller pair 50, a discharge roller pair 60, a supporting member 70, a movable member 80, an outer guide member 18, two biasing members 98 and 99, and an interlocking mechanism 90.

As shown in FIG. 1, through the front surface of the printer unit 11 is formed an opening 13. The printer unit 11 is provided with a feeding tray 20 which is able to store sheets 12 with different sizes. The feeding tray 20 is supported by the casing 11*a* to be attachable and detachable in the front-rear direction 8 through the opening 13. On an upper side of the feeding tray 20, a discharge tray 21 is provided. The discharge tray 21 is moved together with the feeding tray 20. The discharge tray 21 supports a sheet 12 on which an image has been recorded by a later-described recording unit 24 and has been discharged by the discharge roller pair 60.

As shown in FIG. 1, the casing 11*a* has an outer cover 14 which covers the outside of the casing 11*a*. As shown in FIG.

Figure 5A:
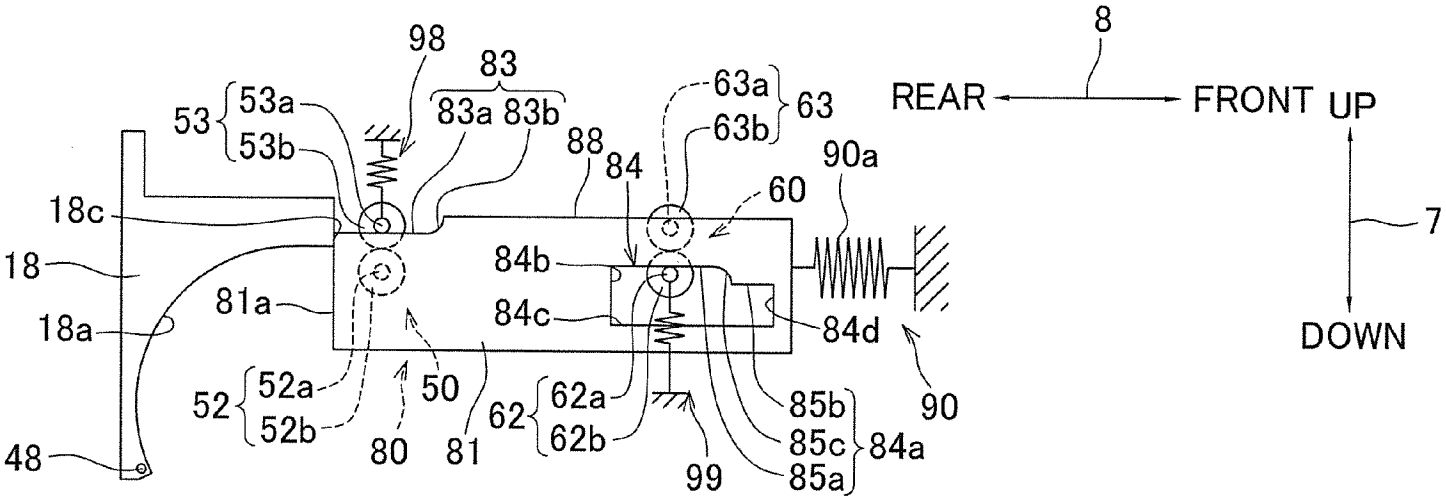
Figure 5B:
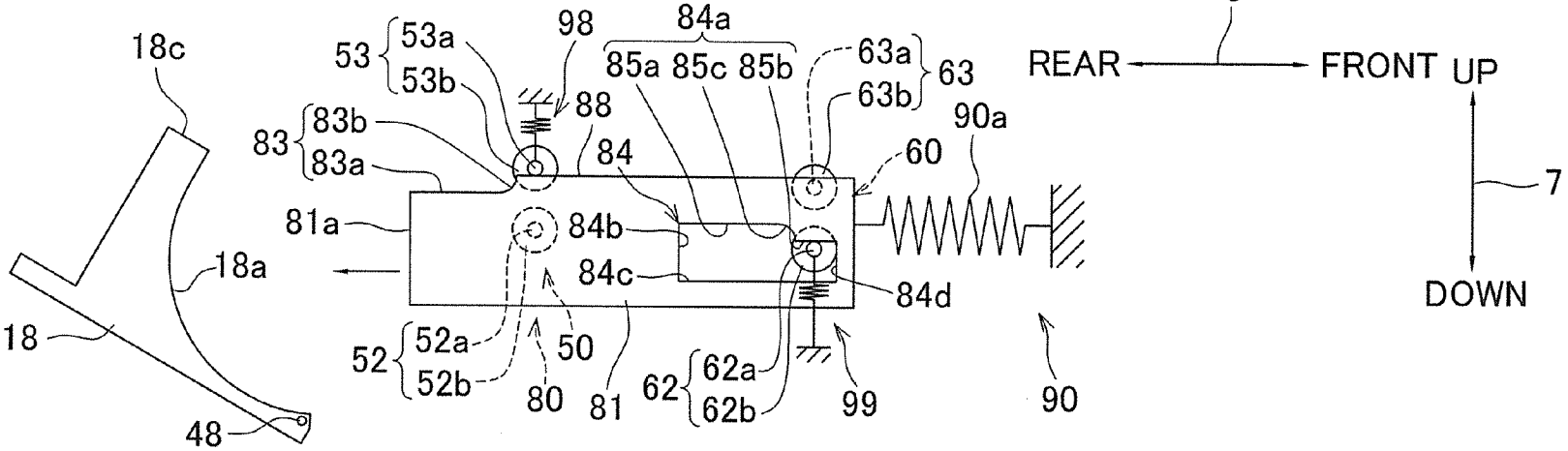
FIG. 5B shows the relationship of operations of the conveyor roller pair, the discharge roller pair, and a movable member when the outer guide member shown in FIG. 5A is in the open state.

2 to FIG. 5B, the casing 11*a* is a main frame of the printer unit 11, and houses and supports the feeding unit 16, the conveyor roller pair 50, the recording unit 24, the platen 42, the discharge roller pair 60, the supporting member 70, the movable member 80, the two biasing members 98 and 99, and the interlocking mechanism 90.

As shown in FIG. 2, the feeding unit 16 picks up a sheet 12 from the feeding tray 20 and feeds the sheet 12 to a conveyance passage 35. The conveyor roller pair 50 conveys the sheet 12 having been fed to the conveyance passage 35 by the feeding unit 16 to the downstream in a conveyance direction 15. The platen 42 supports, from below, the sheet 12 conveyed by the conveyor roller pair 50. The recording unit 24 records an image on the sheet 12 supported by the platen 42, by ejecting ink droplets. The discharge roller pair 60 discharges, to the discharge tray 21, the sheet 12 on which the image has been recorded by the recording unit 24.

Conveyance Passage 35

As shown in FIG. 2, the conveyance passage 35 extends from a rear end portion of the feeding tray 20. The conveyance passage 35 includes a curved conveyance passage 33 and a linear conveyance passage 34. The curved conveyance passage 33 curves and extends in such a way that the rear side of the printer unit 11 is the outer side of the curve whereas the front side of the printer unit 11 is the inner side of the curve. The linear conveyance passage 34 extends in the front-rear direction 8. The sheet 12 supported by the feeding tray 20 is conveyed upward on the curved conveyance passage 33 to make a U-turn, and is then conveyed forward in the front-rear direction 8 on the linear conveyance passage 34 and reaches the recording unit 24. The sheet 12 on which an image has been formed by the recording unit 24 is conveyed further forward in the front-rear direction 8 on the linear conveyance passage 34, and is then discharged to the discharge tray 21. In other words, the sheet 12 is conveyed in the conveyance direction 15 indicated by dashed arrows shown in FIG. 2.

The curved conveyance passage 33 is constituted by an outer guide member 18 and an inner guide member 19 which oppose each other over a predetermined gap. The outer guide member (cover member) 18 includes a guide face 18*a* which forms the outer side of the curve of the curved conveyance passage 33. The inner guide member 19 includes a guide face 19*a* which forms the inner side of the curve of the curved conveyance passage 33. The linear conveyance passage 34 is constituted by the recording unit 24 and the platen 42 which oppose each other over a predetermined gap. As such, each of the guide members 18 and 19 forms at least a part of the conveyance passage 35.

Figure 3:
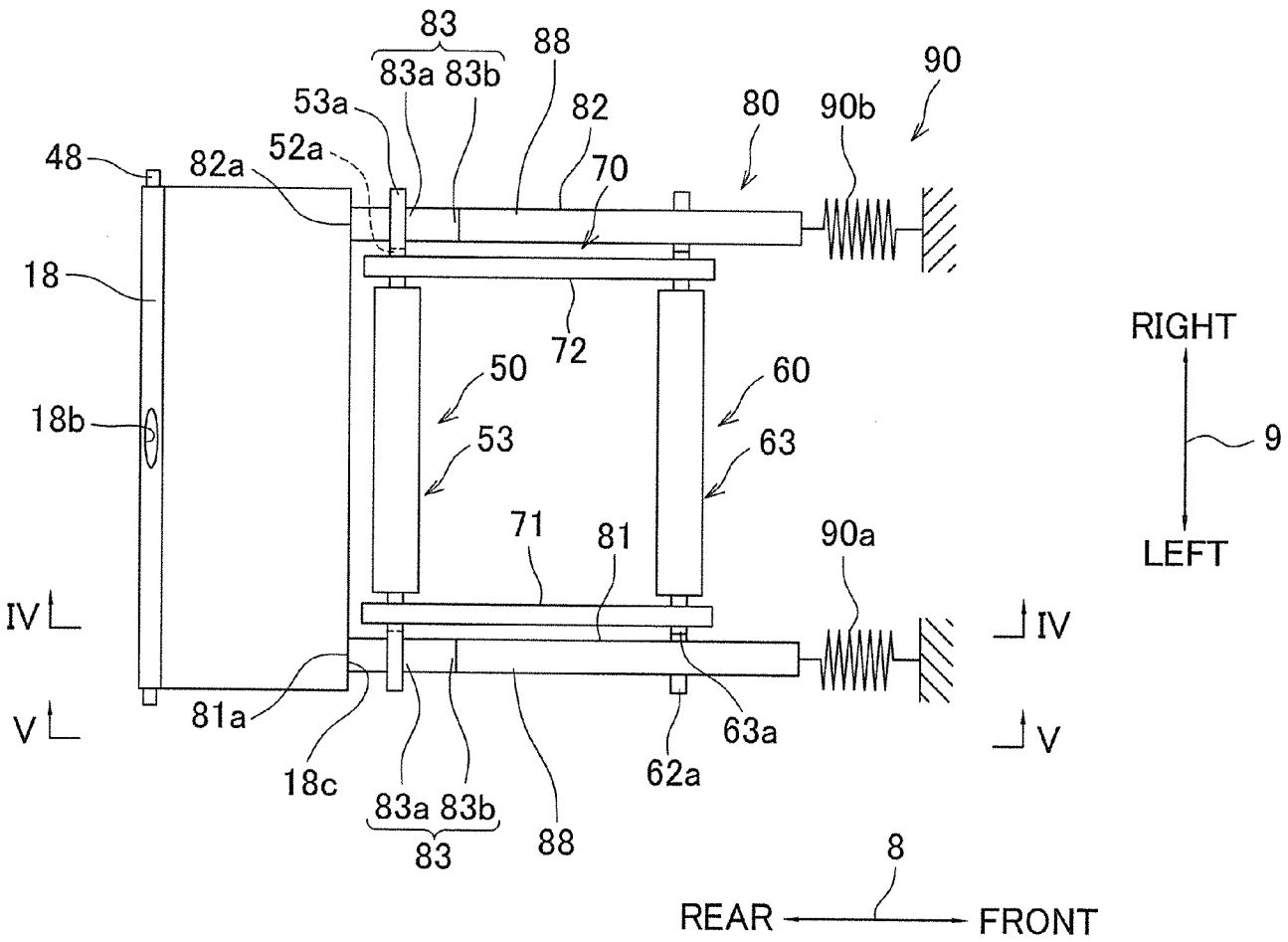
FIG. 3 is a schematic plan view of the conveyor shown in FIG. 2.

As shown in FIG. 2, the outer guide member 18 is rotatably supported by the casing 11*a*. At the respective edges in a lower end portion of the outer guide member 18 in the left-right direction 9, as shown in FIG. 3, shafts 48 are formed to extend in the left-right direction 9. In the present embodiment, the shafts 48 are protruding portions protruding outward from the edges of the outer guide member 18 in the left-right direction 9. The shafts 48 are inserted into unillustrated holes formed through the casing 11*a*. This allows the outer guide member 18 to rotate between a covering position (indicated by the full lines in FIG. 2) where the curved conveyance passage 33 is covered and an exposing position (indicated by two-dot chain lines in FIG. 2) where the curved conveyance passage 33 is exposed. When the outer guide member 18 is in the covering position, a closed state is taken so that the outer guide member 18 and the inner guide member 19 opposing the same constitute the curved conveyance passage 33. In the meanwhile, when the outer guide member 18 is in the exposing position, an open state is taken so that the guide face 19*a* of the inner guide member 19 is exposed to the outside and the curved conveyance passage 33 is opened. This allows the user of the multifunction machine 10 to remove a sheet 12 jammed in the curved conveyance passage 33 (so-called jam treatment process).

In addition to the above, as shown in FIG. 2, the casing 11*a* has a protruding portion 11*b* configured to be engaged with the outer guide member 18. The outer guide member 18 has a recess 18*b* in which the protruding portion 11*b* is provided when the outer guide member 18 is in the closed state. As the protruding portion 11*b* and the recess 18*b* are engaged with each other, the closed state of the outer guide member 18 is maintained.

Feeding Unit 16

As shown in FIG. 2, the feeding unit 16 is provided on the upstream in the conveyance direction 15 of the curved conveyance passage 33, above the feeding tray 20, and below the recording unit 24. The feeding unit 16 includes a feed roller 25, a feed arm 26, and a drive transmission mechanism 27. The feed roller 25 pivots on the leading end portion of the feed arm 26. The feed arm 26 is supported by the casing 11a to be rotatable in the directions of arrows 29 about a supporting shaft 28 provided at the proximal end portion. With this arrangement, the feed roller 25 is able to contact with and to be separated from the feeding tray 20 or a sheet 12 supported by the feeding tray 20. The feed roller 25 is rotated by receiving a driving force of an unillustrated conveyance motor, which is transmitted by a drive transmission mechanism 27 formed by engaged gears. In this manner, the sheet 12 on the feeding tray 20 is conveyed toward the conveyance passage 35. The feed roller 25 may be rotated by receiving a driving force from a motor which is independent from the conveyance motor.

Conveyor Roller Pair 50

As shown in FIG. 2, the conveyor roller pair 50 is constituted by a conveyor roller 52 (second roller, second roller unit) and a pinch roller 53 (first roller, first roller unit), and is provided on the upstream in the conveyance direction 15 of the recording unit 24. The conveyor roller 52 in the present embodiment is provided below the pinch roller 53, and contacts with the lower surface of the sheet 12 guided from the curved conveyance passage 33 to the linear conveyance passage 34. The conveyor roller 52 is rotated by receiving a driving force from the conveyance motor. The conveyor roller 52 is constituted by a shaft member 52*a* which receives the driving force from the conveyance motor so as to rotate and a roller 52*b* which is externally fitted to the shaft member 52*a* and rotates together with the shaft member 52*a*.

In the meanwhile, the pinch roller 53 is disposed to oppose the conveyor roller 52 and contacts with the upper surface of the sheet 12. The pinch roller 53 is constituted by a shaft member 53*a* and a roller 53*b* which is externally fitted to the shaft member 53*a* and is rotated in accordance with the rotation of the conveyor roller 52. In the left-right direction 9, the shaft member 53*a* is longer than the shaft member 52*a*. To be more specific, as shown in FIG. 3, in the left-right direction 9, the shaft member 52*a* is shorter than the interval between later-described paired movable plates 81 and 82 and is long enough to be supported by later-described paired supporting plates 71 and 72, whereas the shaft member 53*a* is long enough to be able to contact with the paired movable plates 81 and 82. The conveyor roller 52 and the pinch roller 53 work together to hold the sheet 12 in the up-down direction 7, and convey the sheet 12 in the conveyance direction 15.

The conveyor roller 52 positively rotates as it receives a driving force from the conveyance motor. The positive rotation of the conveyor roller 52 is rotation in a direction in which the sheet 12 is conveyed in the conveyance direction 15. In other words, in FIG. 2, the positive rotation of the conveyor roller 52 is clockwise rotation, whereas the positive rotation of the pinch roller 53 is anti-clockwise rotation.

Discharge Roller Pair 60

As shown in FIG. 2, the discharge roller pair 60 is constituted by a discharge roller 62 (third roller, third roller unit) and a spur roller 63 (fourth roller, fourth roller unit), and is provided on the downstream in the conveyance direction 15 of the recording unit 24. The discharge roller 62 in the present embodiment is provided below the spur roller 63 and contacts with the lower surface of the sheet 12 conveyed on the linear conveyance passage 34. The discharge roller 62 is constituted by a shaft member 62*a* which rotates as it receives a driving force from the conveyance motor and a roller 62*b* which is externally fitted to the shaft member 62*a* and rotates together with the shaft member 62*a*.

In the meanwhile, the spur roller 63 is provided to oppose the discharge roller 62 and contacts with the upper surface of the sheet 12. The spur roller 63 is constituted by a shaft member 63*a* and a spur 63*b* which is externally fitted to the shaft member 63*a* and is rotated in accordance with the rotation of the discharge roller 62. The shaft member 63*a* is formed to be shorter than the shaft member 62*a* in the left-right direction 9. To be more specific, as shown in FIG. 3, in the left-right direction 9, the shaft member 63*a* is shorter than the interval between later-described paired movable plates 81 and 82 and is long enough to be supported by the paired supporting plates 71 and 72. The shaft member 62*a* is long enough to be able to contact with the paired movable plates 81 and 82. The discharge roller 62 and the spur roller 63 cooperate and hold the sheet 12 in the up-down direction 7, and convey the sheet 12 in the conveyance direction 15. As a result, the sheet 12 is conveyed from the discharge roller pair 60 toward the opening 13 which is on the downstream in the conveyance direction 15, and is then discharged to the discharge tray 21.

The discharge roller 62 positively rotates as it receives a driving force from the conveyance motor. The positive rotation of the discharge roller 62 is rotation in the direction of conveying the sheet 12 in the conveyance direction 15. Therefore, in FIG. 2, the positive rotation of the discharge roller 62 is clockwise rotation, whereas the positive rotation of the spur roller 63 is anticlockwise rotation.

Platen 42

As shown in FIG. 2, the platen 42 is provided below the linear conveyance passage 34 and between the conveyor roller pair 50 and the discharge roller pair 60. The platen 42 is disposed to oppose the recording unit 24 in the up-down direction 7, and is a plate-shaped component which supports, from below, the sheet 12 conveyed in the linear conveyance passage 34.

Recording Unit 24

As shown in FIG. 2, the recording unit 24 is disposed above the linear conveyance passage 34 to oppose the platen 42 in the up-down direction 7. The recording unit 24 includes a carriage 40 and a record head 38. The carriage 40 is supported by two guide rails 45 and 46. The two guide rails 45 and 46 are disposed to be separated from each other in the front-rear direction 8, and each of which extends in the left-right direction 9. The carriage 40 is provided to contact with the two guide rails 45 and 46, and is configured to reciprocate along the two guide rails 45 and 46 in the left-right direction 9 which is a main scanning direction. The record head 38 is mounted on the carriage 40. The record head 38 ejects ink supplied from an unillustrated ink cartridge, through nozzles 39 in the lower surface of the record head 38. Therefore, as ink droplets are ejected from the nozzles 39 of the record head 38 toward the platen 42 while the carriage 40 is moving in the left-right direction 9, an image is recorded on the upper surface of the sheet 12 supported by the platen 42.

Supporting Member 70

Figure 4A:
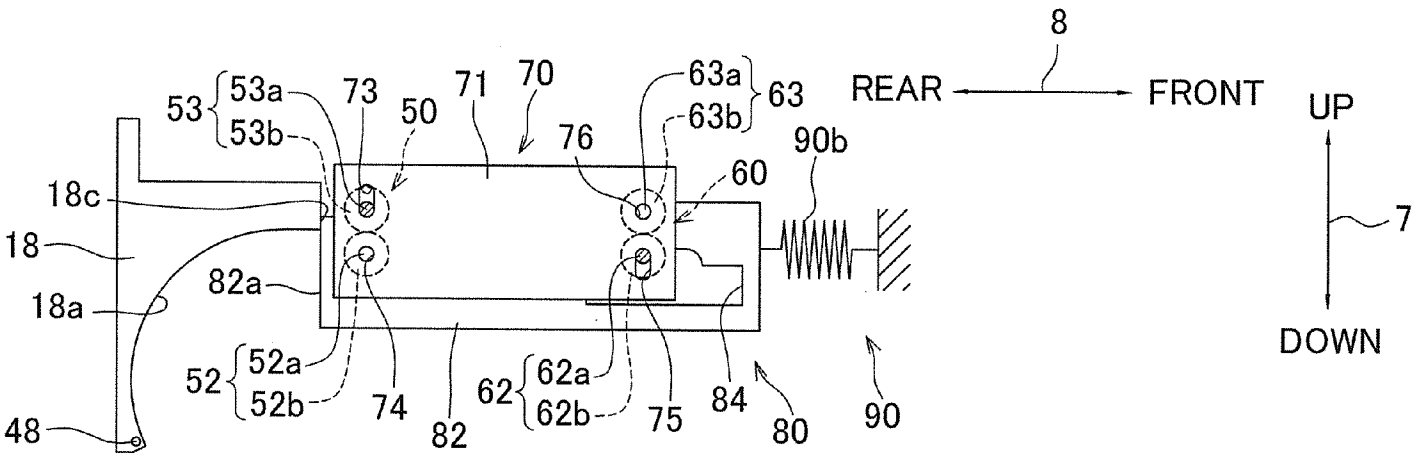
Figure 4B:
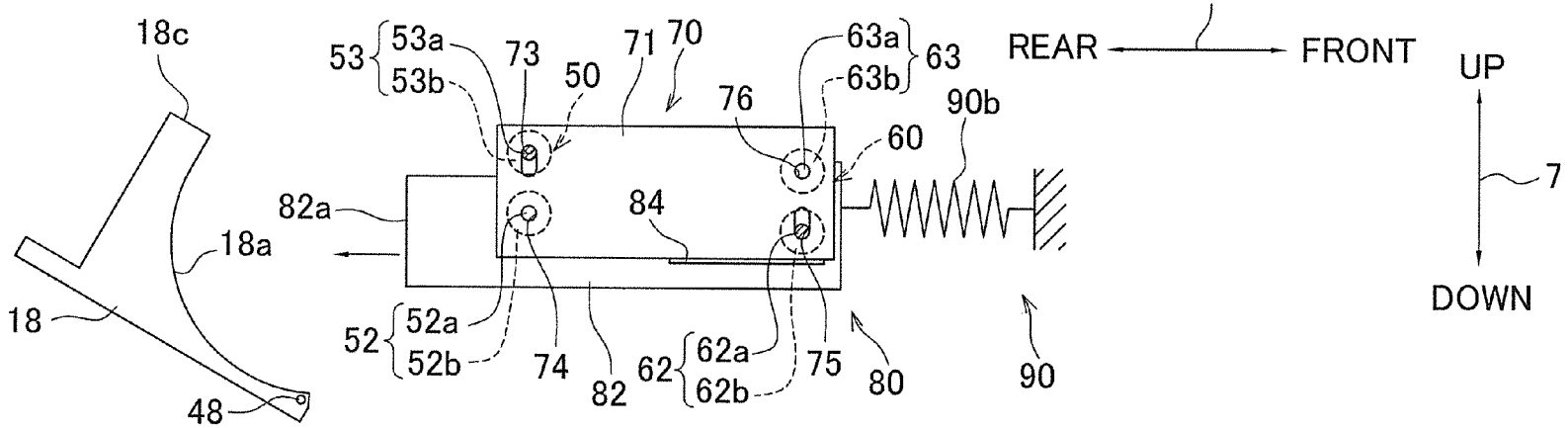
FIG. 4B shows the relationship of operations of a conveyor roller pair, a discharge roller pair, and a supporting member when the outer guide member shown in FIG. 4A is in the open state.

As shown in FIG. 3, FIG. 4A, and FIG. 4B, the supporting member 70 includes paired supporting plates 71 and 72 which are separated from each other in the left-right direction 9. As shown in FIG. 4A and FIG. 4B, each of these supporting plates 71 and 72 is rectangular in plan view and fixed to the casing 11*a*. Because the supporting plates 71 and 72 are identically arranged, the following will describe the supporting plate 71 and the description of the supporting plate 72 will be omitted.

The supporting plate 71 has four holes 73 to 76 which penetrate the supporting plate 71 in the left-right direction 9. Into the hole 73 is inserted the left side of the shaft member 53*a* of the pinch roller 53. Into the hole 74 is inserted the left side of the shaft member 52*a* of the conveyor roller 52. Into the hole 75 is inserted the left side of the shaft member 62*a* of the discharge roller 62. Into the hole 76 is inserted the left side of the shaft member 63*a* of the spur roller 63. In the same manner as in the supporting plate 71, the right sides of the shaft members 53*a*, 52*a*, 62*a*, and 63*a* are inserted into four holes 73 to 76 made through the supporting plate 72, respectively. In this way, the conveyor roller pair 50 and the discharge roller pair 60 are rotatably supported by the supporting member 70.

The two holes 74 and 76 support the shaft members 52*a* and 63*a* to cause the conveyor roller 52 and the spur roller 63 not to be movable. The two holes 73 and 75 are long holes extending in the up-down direction 7, and support the shaft members 53*a* and 62*a* to allow the pinch roller 53 and the discharge roller 62 to be movable in the up-down direction 7. With this, the conveyor roller pair 50 is able to take a first conveyance position shown in FIG. 4A where the shaft member 53*a* contacts with the lower end of the hole 73 and the pinch roller 53 contacts with the conveyor roller 52 and a first retracted position shown in FIG. 4B where the shaft member 53*a* contacts with the upper end of the hole 73 and the pinch roller 53 is separated from the conveyor roller 52. Furthermore, the discharge roller pair 60 is able to take a second conveyance position shown in FIG. 4A where the shaft member 62*a* contacts with the upper end of the hole 75 and the discharge roller 62 contacts with the spur roller 63 and a second retracted position shown in FIG. 4B where the shaft member 62*a* contacts with the lower end of the hole 75 and the discharge roller 62 is separated from the spur roller 63. The first and second conveyance positions are positions where the conveyor roller pair 50 and the discharge roller pair 60 are able to hold and convey the conveyed sheet 12. The first and second retracted positions are positions where the conveyor roller 52 is separated from the pinch roller 53, the discharge roller 62 is separated from the spur roller 63, and the holding force of each of the roller pairs 50 and 60 for holding the sheet 12 is smaller than the holding force in the first and second conveyance positions.

Alternatively, in the first retracted position, while the conveyor roller 52 contacts with the pinch roller 53, the shaft distance between the shaft members 52*a* and 53*a* is longer than the shaft distance in the first conveyance position and hence the holding force of the conveyor roller pair 50 for holding the sheet 12 is smaller than the holding force in the first conveyance position. Furthermore, in the second retracted position, while the discharge roller 62 contacts with the spur roller 63, the shaft distance between the shaft members 62*a* and 63*a* is longer than the shaft distance in the second conveyance position and hence the holding force of the discharge roller pair 60 for holding the sheet 12 is smaller than the holding force in the second conveyance position.

In addition to the above, as shown in FIG. 3, the conveyance passage 35 is, in the left-right direction 9, formed in a region where the rollers 52*b*, 53*b*, and 62*b* and the spur 63*b* of the conveyor roller pair 50 and the discharge roller pair 60 are provided, and the paired supporting plates 71 and 72 are disposed to sandwich the conveyance passage 35. In other words, the paired supporting plates 71 and 72 are provided outside the conveyance passage 35. With this arrangement, the conveyed sheet 12 does not contact with the supporting member 70. This restrains the occurrence of the jamming of the sheet 12 in the conveyance passage 35.

Movable Member 80

As shown in FIG. 3, FIG. 5A, and FIG. 5B, the movable member 80 includes paired movable plates 81 and 82 which are separated from each other to sandwich the supporting member 70 in the left-right direction 9. In other words, the paired movable plates 81 and 82 are provided outside the conveyance passage 35. With this arrangement, the conveyed sheet 12 does not contact with the movable member 80. This restrains the occurrence of the jamming of the sheet 12 in the conveyance passage 35. As shown in FIG. 5A and FIG. 5B, each of these movable plates 81 and 82 is substantially rectangular in plan view and attached to the casing 11*a* to be movable in the front-rear direction 8. To be more specific, the movable member 80 is movable between a first position shown in FIG. 5A and a second position shown in FIG. 5B which is to the rear of the first position. As shown in FIG. 3, the paired movable plates 81 and 82 do not overlap the shaft members 52*a* and 63*a* in the up-down direction 7 but overlap the end portions of the shaft members 53*a* and 62*a*. Because the movable plates 81 and 82 are identically arranged, the following will describe the movable plate 81 and the description of the movable plate 82 will be omitted.

As shown in FIG. 5A and FIG. 5B, the movable plate 81 includes a cutout portion 83 formed by cutting out the upper surface 88 at a rear part in the front-rear direction 8 and a penetrated portion 84 which is formed to the front of the center of the upper surface 88 to penetrate the movable plate 81 in the left-right direction. The cutout portion 83 opposes the pinch roller 53 in the left-right direction 9 when the pinch roller 53 is in the first conveyance position. The cutout portion 83 is constituted by a horizontal surface 83*a* which is in parallel to the upper surface 88 and a curved surface 83*b* which connects the horizontal surface 83*a* with the upper surface 88. The horizontal surface 83*a* is provided to contact with the shaft member 53*a* of the pinch roller 53 in the first conveyance position, when the movable member 80 is in the first position. The upper surface 88 is provided at a location higher than the horizontal surface 83*a* and contacts with the shaft member 53*a* of the pinch roller 53 in the first retracted position when the movable member 80 is in the second position. The horizontal surface 83*a* may not be provided to contact with the shaft member 53*a*.

The penetrated portion 84 has four inner surfaces 84*a* to 84*d* forming a rectangular contour. Among these surfaces, the upper inner surface 84*a* is constituted by two horizontal surfaces 85*a* and 85*b* which are in parallel to the upper surface 88 and a curved surface 85*c* which connects these horizontal surfaces 85*a* and 85*b* with each other. The horizontal surface 85*a* is provided to contact with the shaft member 62*a* of the discharge roller 62 in the second conveyance position, when the movable member 80 is in the first position. The horizontal surface 85*b* is provided at a location lower than the horizontal surface 85*a* and contacts with the shaft member 62*a* of the discharge roller 62 in the second retracted position when the movable member 80 is in the second position. The horizontal surface 85*a* may not be provided to contact with the shaft member 62*a*.

Biasing Members 98 and 99

The biasing member 98 (first biasing member) is constituted by two coil springs which bias the both ends of the shaft member 53*a* downward to bias the pinch roller 53 toward the conveyor roller 52. The biasing member 99 (second biasing member) is constituted by two coil springs which bias the both ends of the shaft member 62*a* to bias the discharge roller 62 toward the spur roller 63. The biasing members 98 and 99 may be constituted by elastic members other than the coil springs.

Interlocking Mechanism 90

The interlocking mechanism 90 is constituted by two coil springs 90*a* and 90*b* (biasing components) which bias the paired movable plates 81 and 82 rearward, respectively. With this arrangement, as shown in FIG. 3 and FIG. 5A, the interlocking mechanism 90 biases the movable member 80 to cause the rear end surfaces 81*a* and 82*a* of the respective movable plates 81 and 82 to contact with the leading end surface 18*c* of the outer guide member 18, when the outer guide member 18 is in the closed state.

Now, the following will describe the operation conditions of the conveyor roller pair 50 and the discharge roller pair 60 when the outer guide member 18 is moved. For example, when a sheet 12 is jammed in the conveyance passage 35, the user moves the outer guide member 18 from the closed state to the open state and removes the jammed sheet 12. When the outer guide member 18 is moved from the closed state to the open state, the movable member 80 biased toward the outer guide member 18 by the interlocking mechanism 90 is moved from the first position shown in FIG. 5A to the second position shown in FIG. 5B, in sync with the movement of the outer guide member 18. When the movable member 80 is in the first position, as shown in FIG. 4A and FIG. 5A, the shaft member 53*a* contacts with the lower end of the hole 73 and the horizontal surface 83*a* and the conveyor roller pair 50 is in the first conveyance position, whereas the shaft member 62*a* contacts with the upper end of the hole 75 and the horizontal surface 85*a* and the discharge roller pair 60 is in the second conveyance position.

When the movable member 80 is moved from the first position to the second position, the shaft member 53*a* leaves the horizontal surface 83*a* and serially contacts with the curved surface 83*b* and the upper surface 88 one by one, and the movable member 80 moves the shaft member 53*a* upward against the biasing force of the biasing member 98. As a result, the shaft member 53*a* is positioned to contact with the upper end of the hole 73, and the conveyor roller pair 50 is switched from the first conveyance position to the first retracted position. At this stage, furthermore, the shaft member 62*a* leaves the horizontal surface 85*a* and serially contacts with the curved surface 85*c* and the horizontal surface 85*b* one by one, and the movable member 80 moves the shaft member 62*a* downward against the biasing force of the biasing member 99. As a result, the shaft member 62*a* is positioned to contact with the lower end of the hole 75, and the discharge roller pair 60 is switched from the second conveyance position to the second retracted position. Because the movable member 80 switches the conveyor roller pair 50 and the discharge roller pair 60 to the retracted positions as above, the jammed sheet 12 is easily removable even if the sheet 12 is held by the conveyor roller pair 50 and the discharge roller pair 60.

After the user removes the jammed sheet P and the outer guide member 18 is moved from the open state to the closed state, the outer guide member 18 contacts with the movable member 80, and the movable member 80 is moved from the second position to the first position in sync with the movement of the outer guide member 18, against the biasing force of the interlocking mechanism 90. When the movable member 80 is moved from the second position to the first position, the shaft member 53*a* is moved downward by the biasing force of the biasing member 98 so as to leave the upper surface 88 and serially contacts with the curved surface 83*b* and the horizontal surface 83*a* one by one. As a result, the shaft member 53*a* is positioned to contact with the lower end of the hole 73 and the conveyor roller pair 50 is switched from the first retracted position to the first conveyance position. At this stage, furthermore, the shaft member 62*a* is moved upward by the biasing force of the biasing member 99 so as to leave the horizontal surface 85*b* and serially contact with the curved surface 85*c* and the horizontal surface 85*a* one by one. As a result, the shaft member 62*a* is positioned to contact with the upper end of the hole 75 and the discharge roller pair 60 is switched from the second retracted position to the second conveyance position. As such, it is possible to automatically switch the conveyor roller pair 50 and the discharge roller pair 60 to the conveyance positions only by switching the state of the outer guide member 18 to the closed state. For this reason, when the sheet 12 is re-conveyed, the conveyor roller pair 50 and the discharge roller pair 60 certainly take the conveyance positions and the sheet 12 is properly conveyed.

As described above, in the multifunction machine 10 employing the conveyor 1 of the present embodiment, the movable member 80 is moved from the second position to the first position, when the outer guide member 18 taking the open state is switched to the closed state for the conveyance of the sheet 12. For this reason, even if the conveyor roller pair 50 is in the first retracted position, the conveyor roller pair 50 is switched to the first conveyance position when the sheet 12 is conveyed. This makes it possible to properly convey the sheet 12. Furthermore, in addition to the conveyor roller pair 50, the discharge roller pair 60 also takes the second conveyance position or the second retracted position in the same manner as the conveyor roller pair 50. This facilitates the removal of the jammed sheet 12, and the sheet 12 is properly conveyed as the discharge roller pair 60 is in the second conveyance position when the sheet 12 is conveyed.

In addition to the above, in the closed state, the outer guide member 18 is biased by the interlocking mechanism 90 via the movable member 80. Therefore the protruding portion 11*b* and the recess 18*b* for keeping the outer guide member 18 to be in the closed state contact with each other without any gap therebetween, and the outer guide member 18 is positioned. The position of the guide face 18*a* which is a part of the conveyance passage 35 therefore becomes stable.

In addition to the above, the outer guide member 18 is rotatably attached to the casing 11*a*. With this, the positional relationship with the movable member 80 is easily determined as compared to a case where the outer guide member 18 is detachable from the casing 11*a*, and hence the interlocking is facilitated.

In addition to the above, in the first refracted position the conveyor roller 52 and the pinch roller 53 are separated from each other, whereas in the second retracted position the discharge roller 62 and the spur roller 63 are separated from each other. This makes it easy to remove the jammed sheet 12 from the gap between the rollers.

In addition to the above, because of the inclusion of the two biasing members 98 and 99, the conveyor roller pair 50 certainly takes the first conveyance position or the first retracted position and the discharge roller pair 60 certainly takes the second conveyance position or the second retracted position.

When the movable member 80 is moved from the first position to the second position, either the conveyor roller 52 or both the conveyor roller 52 and pinch roller 53 may be moved to take the first retracted position. In another modification, when the movable member 80 is moved from the first position to the second position, either the spur roller 63 or both the discharge roller 62 and the spur roller 63 may be moved to take the second retracted position. The conveyor 1 may include only one of the conveyor roller pair 50 and the discharge roller pair 60. While in the embodiment above the pinch roller 53 is employed as the first roller unit, the conveyor roller 52 is employed as the second roller unit, the discharge roller 62 is employed as the third roller unit, and the spur roller 63 is employed as the fourth roller unit, each roller unit may include another supporting member which supports the shaft member of each roller. In this case, by arranging this supporting member to be moved instead of the shaft member by the movable member 80, the switching from the first and second conveyance positions to the first and second retracted positions as in the embodiment and modifications above may be achieved.

In another modification, the biasing member 98 may not be provided. In this case, the pinch roller 53 returns from the first retracted position to the first conveyance position by its own weight. In another modification, the biasing member for biasing the spur roller 63 toward the discharge roller 62 may not be provided for moving the spur roller in the up-down direction 7. Also in this case, the spur roller 63 returns from the second retracted position to the second conveyance position by its own weight.

In addition to the above, the interlocking mechanism 90 may be constituted by another elastic member instead of the two coil springs 90*a* and 90*b*. The interlocking mechanism may be constituted by a link mechanism which moves the movable member 80 from the first position to the second position when the outer guide member 18 is switched from the closed state to the open state and moves the movable member 80 from the second position to the first position when the outer guide member 18 is switched from the open state to the closed state. Furthermore, the outer guide member 18 may be detachable from the casing 11*a*.

The present invention can be employed not only in multifunction machines but also in line-type or serial-type inkjet printers and laser-type or thermal-type recording apparatuses. Furthermore, the paper may not be the sheet 12 as long as it is sheet-shaped.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A conveyor comprising:

a first roller unit including a first roller;

a second roller unit including a second roller which opposes the first roller and is configured to convey a sheet while holding the sheet with the first roller;

a casing which houses the first and second rollers;

a supporting member fixed to the casing, the supporting member supporting the first and second roller units to allow the first and second rollers to take one of a first conveyance position where the first roller and the second roller convey the sheet while holding the sheet and a first retracted position where a holding force by which the sheet is held by the first roller and the second roller is smaller than a holding force at the first conveyance position;

a movable member movably supported by the casing, wherein the movable member is engaged with at least one of the first and second roller units and is movable between a first position where the first roller and the second roller take the first conveyance position and a second position where the first roller and the second roller take the first retracted position;

a cover member which includes a guide unit which is a part of a conveyance passage for conveying the sheet and is switchable between a closed state where the cover member is a part of the conveyance passage and an open state where a part of the conveyance passage is open; and an interlocking mechanism which is configured to move the movable member to the second position when the cover member is in the open state and to move the movable member to the first position when the cover member is in the closed state, wherein the interlocking mechanism includes a biasing component which biases the movable member toward the cover member to cause the movable member to contact with the cover member at least when the cover member is in the closed state.

2. The conveyor according to claim 1, wherein, in the first retracted position, the first roller and the second roller are separated from each other.

3. The conveyor according to claim 1, wherein, the casing houses the supporting member, the interlocking mechanism, and the movable member, and the cover member is rotatably attached to the casing.

4. The conveyor according to claim 1, wherein, the movable member is provided outside the conveyance passage in a direction orthogonal to a conveyance direction of the sheet.

5. The conveyor according to claim 1, wherein the movable member contacts with at least one of the first and second roller units at least when the movable member is in the second position.

6. The conveyor according to claim 5, wherein the movable member includes a contact position where the movable member contacts with at least one of the first and second roller units, wherein the contact position changes as the movable member moves between the first position and the second position.

7. The conveyor according to claim 6, wherein the movable member includes first and second engaging surfaces, the first engaging surface engaging at least one of the first and second roller units when the movable member is at the first position, the second engaging surface engaging the at least one of the first and second roller units when the movable member is at the second position, and wherein first and second engaging surfaces are spaced apart in a moving direction of the movable member and in a moving direction of the first and second roller units.

8. The conveyor according to claim 1, wherein a moving direction of the movable member between the first position and the second position is orthogonal to a moving direction of the first and second rollers between the conveyance position and the retracted position.

9. The conveyor according to claim 1, wherein, the movable member is slidable between a first position and a second position, the movable member at the first position slides to the second position due to biasing force exerted by the biasing component as the cover member is changed from a closed state to an open state, and the movable member at the second position slides to the first position against the biasing force exerted by the biasing component as the cover member is changed from the open state to the closed state and the movable member makes contact with the cover member.

10. The conveyor according to claim 1, wherein, the cover member includes a holding member which makes contact with a housing to hold the cover member at the closed state against the biasing force of the biasing component exerted via the movable member at the first position.

11. The conveyor according to claim 1, wherein, the biasing component is an elastic member.

12. The conveyor according to claim 1, wherein, the biasing component biases the movable member toward the cover member so that the movable member directly makes contact with the cover member.

13. The conveyor according to claim 1, wherein the movable member includes:

a first end portion in the movable direction that is connected with the biasing component, and a second end portion that is in contact with the cover member when the movable member is at the first position.

14. A conveyor comprising:

a first roller unit including a first roller;

a second roller unit including a second roller which opposes the first roller and is configured to convey a sheet while holding the sheet with the first roller;

a third roller unit which includes a third roller which is provided on the downstream of the first and second rollers in a conveyance direction of the sheet;

a fourth roller unit which includes a fourth roller which opposes the third roller and is configured to convey the sheet while holding the sheet with the third roller;

a supporting member which supports the first and second roller units to allow the first and second rollers to take one of a first conveyance position where the first roller and the second roller convey the sheet while holding the sheet and a first retracted position where a holding force by which the sheet is held by the first roller and the second roller is smaller than a holding force at the first conveyance position;

a movable member which is engaged with at least one of the first and second roller units and is movable between a first position where the first roller and the second roller take the first conveyance position and a second position where the first roller and the second roller take the first retracted position;

a cover member which includes a guide unit which is a part of a conveyance passage for conveying the sheet and is switchable between a closed state where the cover member is part of the conveyance passage and an open state where a part of the conveyance passage is open; and an interlocking mechanism which is configured to move the movable member to the second position when the cover member is in the open state and to move the movable member to the first position when the cover member is in the closed state, wherein the interlocking mechanism includes a biasing component which biases the movable member toward the cover member to cause the movable member to contact with the cover member at least when the cover member is in the closed state, the supporting member supporting the third and fourth rollers to allow the third and fourth rollers to take one of a second conveyance position where the third roller and the fourth roller convey the sheet while holding the sheet and a second retracted position where a holding force by which the third roller and the fourth roller hold the sheet is smaller than a holding force at the second conveyance position, and the movable member being engaged with at least one of the third and fourth roller units, and causing the third roller and the fourth roller to take the second conveyance position when the movable member is in the first position and causing the third roller and the fourth roller to take the second retracted position when the movable member is in the second position.

15. The conveyor according to claim 14, wherein, in the second retracted position, the third roller and the fourth roller are separated from each other.

16. The conveyor according to claim 14, further comprising:

a first biasing member which biases the first roller toward the second roller; and a second biasing member which biases the third roller toward the fourth roller, the movable member contacting with the first and third roller units at least when the movable member is in the second position.

* * * * *